US008057198B2

(12) United States Patent
Pietron et al.

(10) Patent No.: US 8,057,198 B2
(45) Date of Patent: Nov. 15, 2011

(54) VARIABLE DISPLACEMENT PIEZO-ELECTRIC PUMPS

(75) Inventors: Greg Michael Pietron, Canton, MI (US); Bud Orley Burkhart, Novi, MI (US); James William Loch McCallum, Ann Arbor, MI (US); Yuji Fujii, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 792 days.

(21) Appl. No.: 11/950,787

(22) Filed: Dec. 5, 2007

(65) Prior Publication Data

US 2009/0148317 A1 Jun. 11, 2009

(51) Int. Cl.
*F04B 17/00* (2006.01)

(52) U.S. Cl. ..... 417/413.2; 92/49; 92/99

(58) Field of Classification Search ..... 417/413.1, 417/413.2; 92/6 D, 49, 99
See application file for complete search history.

(56) References Cited

U.S. PATENT DOCUMENTS

| | | | | |
|---|---|---|---|---|
| 2,936,785 | A * | 5/1960 | Hastings | 92/49 |
| 4,768,556 | A * | 9/1988 | Rees | 137/627.5 |
| 4,856,966 | A | 8/1989 | Ozawa | |
| 4,983,876 | A * | 1/1991 | Nakamura et al. | 310/328 |
| 5,044,891 | A | 9/1991 | Ozawa | |
| 5,085,562 | A | 2/1992 | Van Lintel | |
| 5,437,218 | A | 8/1995 | Papin | |
| 6,416,294 | B1 * | 7/2002 | Zengerle et al. | 417/53 |
| 6,514,047 | B2 * | 2/2003 | Burr et al. | 417/53 |
| 6,604,915 | B1 * | 8/2003 | Lindler et al. | 417/322 |
| 6,924,584 | B2 | 8/2005 | Buhler et al. | |
| 7,059,836 | B2 | 6/2006 | Takagi et al. | |
| 7,219,848 | B2 * | 5/2007 | Sweeton | 239/102.2 |
| 7,484,940 | B2 * | 2/2009 | O'Neill | 417/413.2 |
| 2004/0136843 | A1 | 7/2004 | Jahn et al. | |

* cited by examiner

*Primary Examiner* — Charles Freay
*Assistant Examiner* — Patrick Hamo
(74) *Attorney, Agent, or Firm* — David Kelley, Esq.; Tung & Associates

(57) ABSTRACT

A variable displacement piezo-electric pump which includes a pump housing having a side housing wall defining a pump chamber, an inlet line and an outlet line communicating with the pump chamber, a flexible pump diaphragm spanning the side housing wall in the pump chamber, a diaphragm-stroking mechanism such as a piezo-electric stack engaging the pump diaphragm and a diaphragm support provided between the diaphragm-stroking mechanism and the side housing wall of the pump housing.

18 Claims, 3 Drawing Sheets

VARIABLE DISPLACEMENT PIEZO-ELECTRIC PUMPS

TECHNICAL FIELD

The present disclosure relates to pumps. More particularly, the present disclosure relates to variable displacement piezo-electric pumps which are characterized by optimum flow capabilities under high and low pressures.

BACKGROUND

A typical hydraulic actuator has two distinct types of flow demand: high flow to stroke the clutch at relatively low pressures and low flow at high pressure to control the capacity of the clutch. A single piezo-electric pump having a traditional design cannot be optimized for both flow conditions. Such a pump has either a low flow and high pressure capability or a high flow and limited pressure capability. The pressure is dictated by the maximum force that the piezo-electric stack can generate and by the area of the pump piston.

SUMMARY

The present disclosure is generally directed to a variable displacement piezo-electric pump. An illustrative embodiment of the pump includes a pump housing having a side housing wall defining a pump chamber, an inlet line and an outlet line communicating with the pump chamber, a flexible pump diaphragm spanning the side housing wall in the pump chamber, a piezo-electric stack engaging the pump diaphragm and a diaphragm support provided between the piezo-electric stack and the side housing wall of the pump housing.

DETAILED DESCRIPTION

Figure 1:
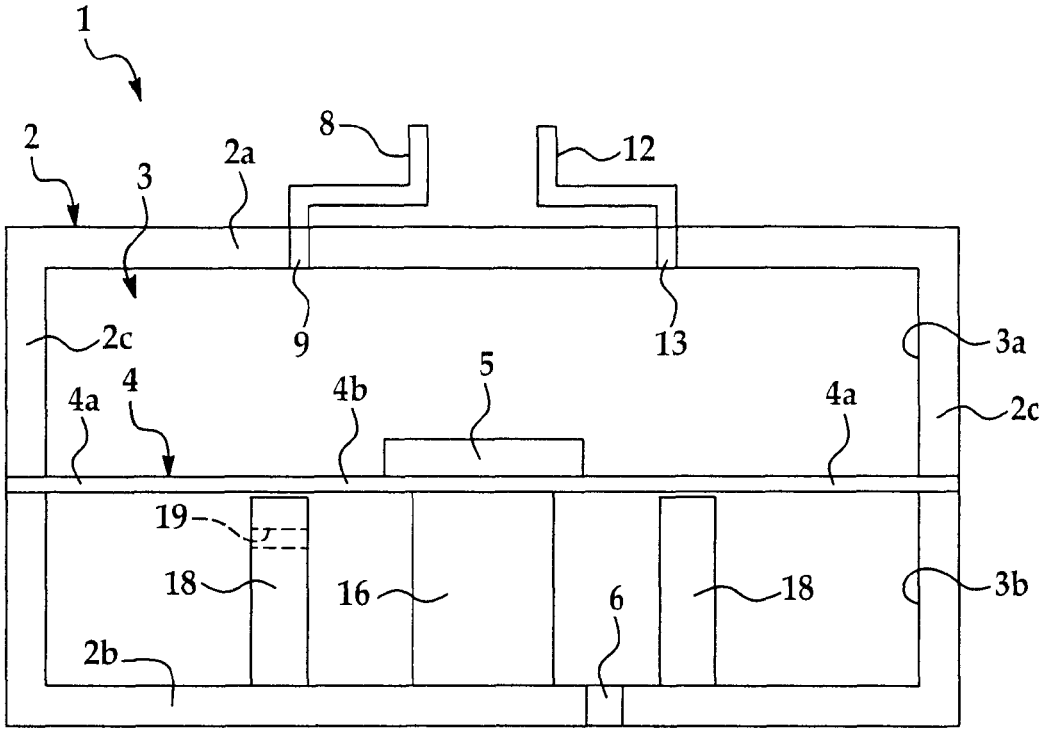
FIG. 1 is a schematic diagram of a continuous diaphragm piezo-electric variable displacement pump with a diaphragm component of the pump shown in a neutral-pressure configuration.
Figure 2:
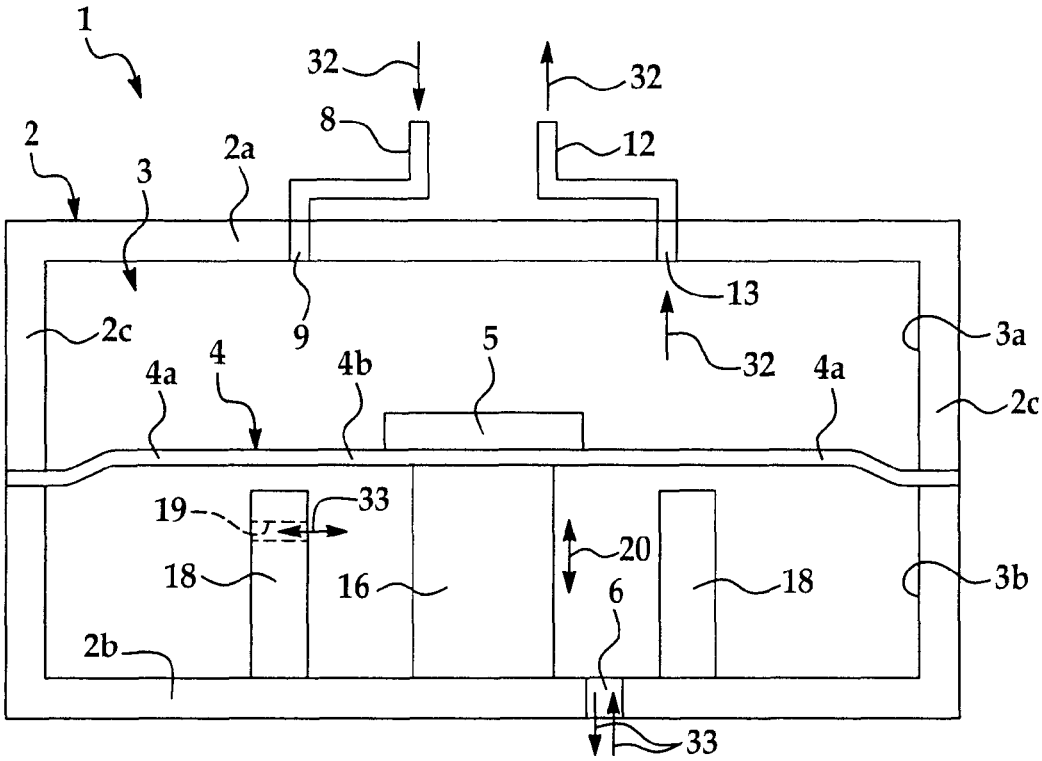
FIG. 2 is a schematic diagram of the continuous diaphragm piezo-electric variable displacement pump, with the diaphragm of the pump shown in a low-pressure high-flow configuration.
Figure 3:
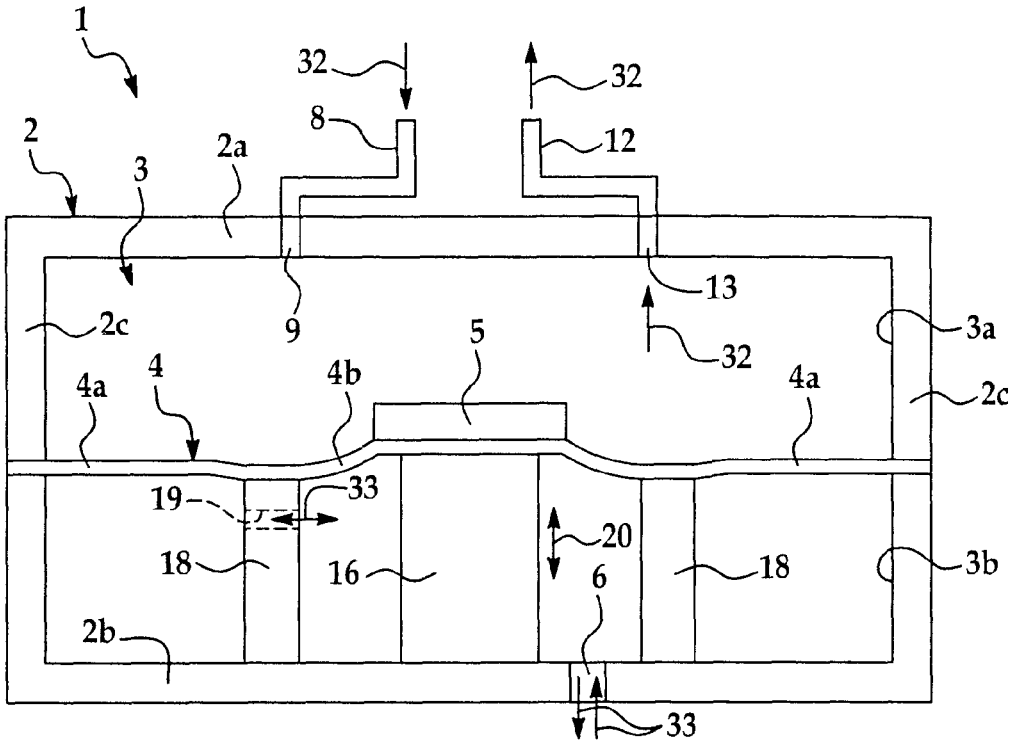
FIG. 3 is a schematic diagram of the continuous diaphragm piezo-electric variable displacement pump, with the diaphragm of the pump shown in a high-pressure low-flow configuration.

Referring initially to FIGS. 1-3 of the drawings, an illustrative embodiment of a continuous diaphragm piezo-electric variable displacement pump, hereinafter pump, is generally indicated by reference numeral 1. As shown in FIG. 1, the pump 1 includes a pump housing 2 which may include a first housing wall 2*a*, a second housing wall 2*b* and a side housing wall 2*c* which extends between the first housing wall 2*a* and the second housing wall 2*b*. The pump housing 2 may be generally cylindrical or may have any other suitable alternative shape and has a pump housing interior 3.

A flexible or elastomeric pump diaphragm 4 spans the side housing wall 2*c* and divides the pump housing interior 3 into a first pump chamber 3*a* and a second pump chamber 3*b*. The pump diaphragm 4 may be circular and includes an outer diaphragm portion 4*a* and an inner diaphragm portion 4*b*. A diaphragm stiffener/retainer 5, which may be disc-shaped, may be provided on the inner diaphragm portion 4*b* in the first pump chamber 3*a* of the pump housing interior 3. In some embodiments, the pump diaphragm 4 may have a tapered thickness to promote the change in displacement of the working fluid 32 in the first pump chamber 3*a*. This may allow for removal of the support 18 from the second pump chamber 3*b*.

An inlet valve 9, which may be a suction check valve, for example, communicates with the first pump chamber 3*a*. The inlet valve 9 may extend through the first housing wall 2*a*, for example, as shown; alternatively, the inlet valve 9 may extend through the side housing wall 2*c*. An inlet suction line 8 communicates with the inlet valve 9 and extends from the pump housing 2. An outlet check valve 13 communicates with the first pump chamber 3*a* and may extend through the first housing wall 2*a*, as shown, or through the side housing wall 2*c*. A high-pressure outlet line 12 communicates with the outlet check valve 13 and extends from the pump housing 2.

A piezo-electric stack 16 or other diaphragm-stroking mechanism is provided in the second pump chamber 3*b* of the pump housing interior 3. The piezo-electric stack 16 extends from the second housing wall 2*b* and engages the inner diaphragm portion 4*b* of the pump diaphragm 4. A diaphragm support 18 extends from the second housing wall 2*b* between the piezo-electric stack 16 and the side housing wall 2*c*. The diaphragm support 18 may be annular and may encircle the piezo-electric stack 16. A vent 6 is provided in the second housing wall 2*b* as shown, or alternatively, in the side housing wall 2*c*. The vent 6 establishes pneumatic communication between the second pump chamber 3*b* and the ambient air outside the pump housing 2. A vent 19 may extend through the diaphragm support 18 to establish pneumatic communication between the inner and outer portions of the second pump chamber 3*b*. Multiple support diaphragms, pistons and intermediate supports can be used in conjunction with the pump diaphragm 4 according to the knowledge of those skilled in the art.

In typical application, the pump 1 can be operated under low-pressure conditions and high-pressure conditions. Working fluid 32 flows into the first pump chamber 3*a* of the pump housing interior 3 through the inlet suction line 8 and inlet valve 9, respectively. As shown in FIG. 2, under low-pressure conditions of the working fluid 32 in the first pump chamber 3*a*, the piezo-electric stack 16 expands and contracts, stroking both the inner diaphragm portion 4*b* and the outer diaphragm portion 4*a* of the pump diaphragm 4, as indicated by the arrow 20. Simultaneously, an external fluid 33, which may be gas or liquid, either at ambient or a controlled pressure, flows into and out of the second pump chamber 3*b* of the pump housing interior 3 through the vent 6. External fluid 33 may also flow between the outer and inner portions of the second pump chamber 3*b* through the vent 19 extending through the diaphragm support 18. The substantially full diameter of the pump diaphragm 4 provides displacement of a large volume of working fluid 32 in the first pump chamber 3*a*. This results in flow of a large volume of the working fluid 32 from the first pump chamber 3*a*, through the outlet check valve 13 and the high-pressure outlet line 12, respectively.

As shown in FIG. 3, under high-pressure conditions of the working fluid 32 in the first pump chamber 3*a*, the working fluid 32 presses against the pump diaphragm 4, which is forced and seated against the diaphragm support 18. The piezo-electric stack 16 expands and contracts, stroking only the inner diaphragm portion 4*b* of the pump diaphragm 4 as indicated by the arrow 20, as the high pressure of the working fluid 32 in the first pump chamber 3*a* continues to press the outer diaphragm portion 4*a* of the pump diaphragm 4 against the diaphragm support 18. The displaced inner diaphragm portion 4*b* of the pump diaphragm 4 provides displacement of a small volume of working fluid 32 in the first pump chamber 3*a*. This results in flow of a small volume of the working fluid 32 from the first pump chamber 3*a*, through the outlet check valve 13 and the high-pressure outlet line 12, respectively.

Figure 4:
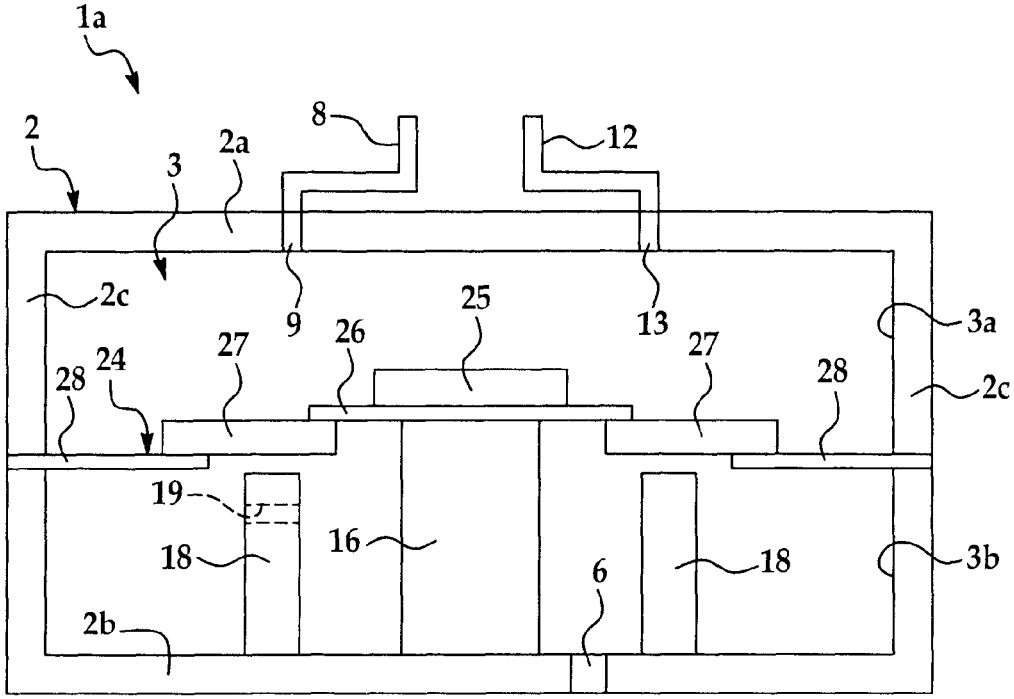
FIG. 4 is a schematic diagram of a variable displacement piezo-electric diaphragm pump with a diaphragm and piston assembly of the pump shown in a neutral-pressure configuration.
Figure 5:
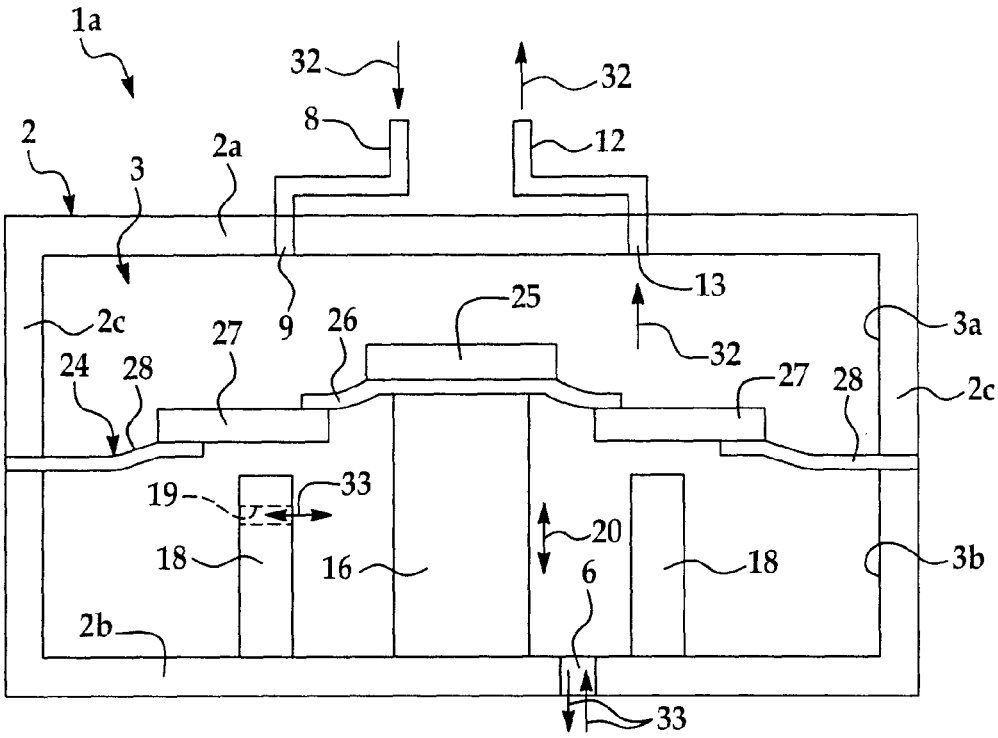
FIG. 5 is a schematic diagram of a variable displacement piezo-electric diaphragm pump with the diaphragm and piston assembly of the pump shown in a low-pressure high-flow configuration.
Figure 6:
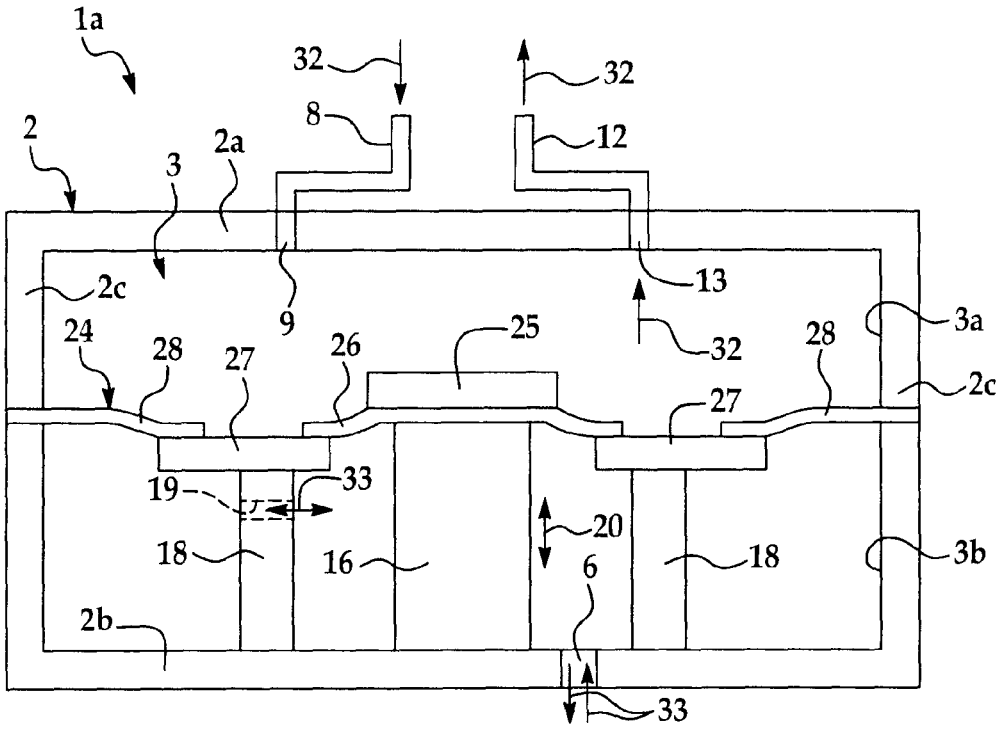
FIG. 6 is a schematic diagram of a variable displacement piezo-electric diaphragm pump with the diaphragm and piston assembly of the pump shown in a high-pressure low-flow configuration.

Referring next to FIGS. 4-6 of the drawings, an illustrative embodiment of a variable displacement piezo-electric diaphragm pump, hereinafter pump, is generally indicated by reference numeral 1*a*. The pump 1*a* includes a pump housing 2 which may have the same design and shape as that of the pump 1 heretofore described with respect to FIGS. 1-3. In the pump 1*a*, a pump diaphragm, which may be a diaphragm and piston assembly 24, spans the side housing wall 2*c* of the pump housing 2 and divides the pump housing interior 3 into the first pump chamber 3*a* and the second pump chamber 3*b*. The diaphragm and piston assembly 24 may include, for example, a flexible outer low-pressure diaphragm 28 which may be annular and extends from the side housing wall 2*c* into the pump housing interior 3. An outer low-pressure piston 27, which may be annular, extends inwardly from the outer low-pressure diaphragm 28. A high-pressure diaphragm 26, which may be circular, is provided at the center of the outer low-pressure piston 27. An inner high-pressure piston 25 is provided on the high-pressure diaphragm 26. The piezo-electric stack 16 in the second pump chamber 3*b* engages the high-pressure diaphragm 26. In some embodiments, the stiffness of the outer low-pressure diaphragm 28 may be selected such that as the pressure of working fluid 32 in the first pump chamber 3*a* rises, the outer low-pressure piston 27 is held in place by the increasing pressure of the working fluid 32. This may render unnecessary the presence of the diaphragm support 18 in the second pump chamber 3*b*. Multiple support diaphragms, pistons and intermediate supports can be used in conjunction with the diaphragm and piston assembly 24 according to the knowledge of those skilled in the art.

In typical application, the pump 1*a* can be operated under low-pressure conditions and high-pressure conditions. Working fluid 32 flows into the first pump chamber 3*a* of the pump housing interior 3 through the inlet suction line 8 and inlet valve 9, respectively. As shown in FIG. 5, under low-pressure conditions of the working fluid 32 in the first pump chamber 3*a*, the piezo-electric stack 16 expands and contracts and strokes the inner high-pressure piston 25, as indicated by the arrow 20. Due to the stiffness of the high-pressure diaphragm 26, the outer low-pressure piston 27 is stroked with the inner high-pressure piston 25. Simultaneously, external fluid 33, which may be gas or liquid, either at ambient or a controlled pressure, is drawn into and out of the second pump chamber 3*b* of the pump housing interior 3 through the vent 6. Stroking of substantially the full diameter of the diaphragm and piston assembly 24 provides displacement of a large volume of working fluid 32 in the first pump chamber 3*a*. This results in flow of a large volume of the working fluid 32 from the first pump chamber 3*a*, through the outlet check valve 13 and the high-pressure outlet line 12, respectively.

As shown in FIG. 6, under high-pressure conditions of the working fluid 32 in the first pump chamber 3*a*, the working fluid 32 presses against the diaphragm and piston assembly 24. Therefore, the outer low-pressure piston 27 is forced and seated against the diaphragm support 18 and the outer low-pressure diaphragm 28 is deflected into the second pump chamber 3*b*. The piezo-electric stack 16 expands and contracts in the direction indicated by the arrow 20, stroking only the inner high-pressure piston 25 and the high-pressure diaphragm 26, as the high pressure of the working fluid 32 in the first pump chamber 3*a* continues to press the outer low-pressure piston 27 of the diaphragm and piston assembly 24 against the diaphragm support 18. The stroking action of the inner high-pressure piston 25 of the diaphragm and piston assembly 24 provides displacement of a small volume of working fluid 32 in the first pump chamber 3*a*. This results in flow of a small volume of the working fluid 32 from the first pump chamber 3*a*, through the outlet check valve 13 and the high-pressure outlet line 12, respectively.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A pump, comprising:

a pump housing having a side housing wall defining a pump chamber;

an inlet line and an outlet line communicating with said pump chamber;

a flexible pump diaphragm spanning said side housing wall in said pump chamber;

a diaphragm-stroking mechanism engaging said pump diaphragm; and an annular-ring shaped diaphragm support that contacts the flexible pump diaphragm directly while allowing relative movement between said pump diaphragm and said diaphragm support, said diaphragm support situated between said diaphragm-stroking mechanism and said side housing wall of said pump housing.

2. The pump of claim 1 wherein said pump diaphragm comprises an outer diaphragm portion and an inner diaphragm portion, and wherein said diaphragm-stroking mechanism engages said inner diaphragm portion.

3. The pump of claim 1 further comprising a diaphragm stiffener/retainer provided on said pump diaphragm.

4. The pump of claim 1 wherein said pump housing comprises a first housing wall and a second housing wall provided on said side housing wall and defining a pump housing interior, and wherein said pump diaphragm divides said pump housing interior into said pump chamber and a second pump chamber adjacent to said pump chamber.

5. The pump of claim 4 wherein said diaphragm-stroking mechanism and said diaphragm support are provided in said second pump chamber.

6. The pump of claim 4 further comprising a vent provided in said second housing wall and communicating with said second pump chamber.

7. The pump of claim 1 wherein said diaphragm-stroking mechanism is a piezoelectric stack.

8. The pump of claim 1 wherein said pump diaphragm comprises a diaphragm and piston assembly.

9. A pump, comprising:

a pump housing having a first housing wall, a second housing wall and a side housing wall extending between said first housing wall and said second housing wall and defining a pump housing interior;

a flexible pump diaphragm spanning said side housing wall in said pump housing interior and defining a first pump chamber and a second pump chamber;

an inlet valve and an outlet valve communicating with said first pump chamber;

an inlet line and an outlet line communicating with said inlet valve and said outlet valve, respectively, and extending from said first pump chamber;

a diaphragm-stroking mechanism provided in said second pump chamber and engaging said pump diaphragm; and an annular-ring shaped diaphragm support that contacts the flexible pump diaphragm directly while allowing relative movement between said pump diaphragm and said diaphragm support, said diaphragm support situated in said second pump chamber and extending between said diaphragm-stroking mechanism and said side housing wall of said pump housing.

10. The pump of claim 9 wherein said pump diaphragm comprises an outer diaphragm portion and an inner diaphragm portion, and wherein said diaphragm-stroking mechanism engages said inner diaphragm portion.

11. The pump of claim 9 further comprising a diaphragm stiffener/retainer provided on said pump diaphragm.

12. The pump of claim 9 further comprising a vent provided in said second housing wall and communicating with said second pump chamber.

13. The pump of claim 9 wherein said diaphragm-stroking mechanism comprises a piezo-electric stack.

14. The pump of claim 9 wherein said pump diaphragm comprises a diaphragm and piston assembly.

15. The pump of claim 9 wherein said diaphragm support is annular and encircles said diaphragm-stroking mechanism.

16. A pump, comprising:

a pump housing having a side housing wall defining a pump chamber; said pump housing comprises a first housing wall and a second housing wall provided on said side housing wall and defining a pump housing interior, and wherein said pump diaphragm divides said pump housing interior into said pump chamber and a second pump chamber adjacent to said pump chamber;

a vent provided in said second housing wall and communicating with said-second pump chamber;

an inlet line and an outlet line communicating with said pump chamber;

a flexible pump diaphragm comprising a diaphragm and piston assembly spanning said side housing wall in said pump chamber;

wherein said diaphragm and piston assembly comprises an outer low-pressure diaphragm extending from said side housing wall, an outer low-pressure piston extending from said outer low-pressure diaphragm, a high-pressure diaphragm extending from said outer low-pressure piston and an inner high-pressure piston provided on said high-pressure diaphragm;

a diaphragm-stroking mechanism engaging said high-pressure diaphragm; and a diaphragm support provided between said diaphragm-stroking mechanism and said side housing wall of said pump housing.

17. The pump of claim 16 wherein said diaphragm-stroking mechanism and said diaphragm support are provided in said second pump chamber.

18. The pump of claim 16 wherein said diaphragm-stroking mechanism comprises a piezo-electric stack.

* * * * *